US007573201B2

(12) United States Patent
Bschorer et al.

(10) Patent No.: US 7,573,201 B2
(45) Date of Patent: Aug. 11, 2009

(54) DIELECTRIC BARRIER DISCHARGE LAMP HAVING PLUGGABLE ELECTRODES

(75) Inventors: Georg Bschorer, Herbrechtingen (DE); Hans-Gerhard Bürzele, Herbrechtingen (DE); Reinhard Lecheler, Neuburg/Donau (DE); Andreas Lochschmidt, Jettingen-Scheppach (DE)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 258 days.

(21) Appl. No.: 11/226,411

(22) Filed: Sep. 15, 2005

(65) Prior Publication Data

US 2006/0066242 A1 Mar. 30, 2006

(30) Foreign Application Priority Data

Sep. 29, 2004 (DE) ..... 10 2004 047 376

(51) Int. Cl.
*H01J 17/18* (2006.01)

(52) U.S. Cl. ..... 313/625; 313/623

(58) Field of Classification Search ..... 313/623–625
See application file for complete search history.

(56) References Cited

U.S. PATENT DOCUMENTS

| | | | | |
|---|---|---|---|---|
| 3,652,848 | A | 3/1972 | Miller et al. | |
| 5,006,758 | A | 4/1991 | Gellert et al. | |
| 5,325,024 | A * | 6/1994 | Piejak et al. | 315/248 |
| 5,343,120 | A | 8/1994 | Mulieri | |
| 5,641,218 | A | 6/1997 | Sakurai | |
| 5,869,931 | A | 2/1999 | Terada | |
| 5,903,091 | A | 5/1999 | MacLennan et al. | |
| 6,100,638 | A | 8/2000 | Shah | |
| 6,304,028 | B1 * | 10/2001 | Vollkommer et al. | 313/491 |
| 6,310,442 | B1 | 10/2001 | Vollkommer et al. | |
| 6,333,509 | B1 | 12/2001 | Lumpp | |
| 6,429,590 | B2 * | 8/2002 | Holzer | 315/51 |
| 6,494,605 | B1 | 12/2002 | Doell | |
| 6,507,028 | B2 | 1/2003 | Sarchese et al. | |
| 6,531,824 | B1 | 3/2003 | Yan | |
| 6,631,100 | B2 | 10/2003 | Utsumi | |
| 6,787,782 | B1 | 9/2004 | Krosney et al. | |
| 2002/0163312 | A1 * | 11/2002 | Kling et al. | 315/56 |
| 2003/0024804 | A1 | 2/2003 | Hammer | |
| 2005/0169821 | A1 | 8/2005 | Boschert et al. | |
| 2006/0066191 | A1 * | 3/2006 | Bschorer et al. | 313/110 |
| 2006/0066211 | A1 | 3/2006 | Bschorer et al. | |
| 2006/0066245 | A1 | 3/2006 | Bschorer et al. | |

FOREIGN PATENT DOCUMENTS

| | | |
|---|---|---|
| CA | 2068574 | 12/1992 |
| DE | 101 11 447 A1 | 9/2002 |
| DE | 102 13 195 A1 | 10/2003 |
| EP | 0 363 832 | 4/1990 |
| EP | 0 517 929 A1 | 12/1992 |
| EP | 0 541 413 A1 | 5/1993 |
| EP | 0 593 311 | 4/1994 |
| EP | 0 860 655 A2 | 8/1998 |
| EP | 1 329 944 A2 | 7/2003 |
| GB | 2399216 | 9/2004 |
| JP | 9-120704 | 5/1997 |

(Continued)

*Primary Examiner*—Vip Patel

(57) ABSTRACT

The invention relates to a dielectric barrier discharge lamp having outer electrodes which have ends in the form of plug connection elements.

24 Claims, 9 Drawing Sheets

FOREIGN PATENT DOCUMENTS

| | | | |
|---|---|---|---|
| JP | 11-317201 | | 11/1999 |
| JP | 2000-285867 | | 10/2000 |
| JP | 2001-155690 | | 6/2001 |
| JP | 2001-319510 | | 11/2001 |
| JP | 2003-168393 | | 6/2003 |
| JP | 2003-317669 | | 11/2003 |
| JP | 2004-170074 | | 6/2004 |
| WO | WO 97/40519 | A1 | 10/1997 |
| WO | WO 99/48134 | | 9/1999 |
| WO | WO 02/27762 | A1 | 4/2002 |

* cited by examiner

DIELECTRIC BARRIER DISCHARGE LAMP HAVING PLUGGABLE ELECTRODES

TECHNICAL FIELD

The present invention relates to a dielectric barrier discharge lamp. Dielectric barrier discharge lamps are understood to mean discharge lamps in which at least the anodes or, in the case of bipolar operation, even all of the electrodes, are isolated from a discharge medium in the discharge vessel by a dielectric layer. This results in automatic quenching of the discharge by internal counterpolarization as a result of the dielectric layer on the anode or the electrode, which in this phase acts as the anode, being electrically charged. Lamp operation therefore takes place finally by means of a dense row of very short discharge flashes.

BACKGROUND ART

Such dielectric barrier discharge lamps have been disclosed in different ways in the prior art and are of interest, owing to various advantageous technical properties, in particular for backlighting displays, for example computer monitors and television screens, or for office automation applications. In the lastmentioned case, lamp shapes which are in the form of elongate rods are generally used which can be used to illuminate documents in scanners, fax machines, copiers or the like. Those discharge lamps having a discharge vessel which is elongate in the form of a tube are likewise already known and accessible. They may also be of interest for other applications, for example as UV radiators for specific technical processes. The present invention is not restricted to a specific application.

Dielectric barrier discharge lamps cannot be operated using a direct current owing to the discharge mechanism which has been outlined in brief, but are operated either using unipolar power supply pulses or using bipolar power supply pulses. The frequencies used are generally of the order of magnitude of a few 10 kHz.

The discharge lamps described which are elongate in the form of tubes have electrodes oriented along the longitudinal extent. This does not necessarily mean that the electrodes need to run as simple, straight strips parallel to the direction of longitudinal extent. They may also be designed to be meandering or to have another form, but overall run along the longitudinal extent. The invention relates to discharge lamps, in which at least two electrodes are fitted outside the discharge vessel, i.e. to its outside. In the prior art, both designs having inner electrodes and those having outer electrodes are known. Outer electrodes generally provide for more simple production but tend towards certain minimum thicknesses of the dielectric layer between the electrode and the discharge medium since the discharge vessel wall itself acts as said dielectric layer.

It is already known to fit such outer electrodes by means of adhesive bonding or by means of transparent film sleeves surrounding the entire discharge lamp.

Contact is generally made with the electrodes by means of soldering or so-called crimping connections. Contact is made with cables which produce a connection to a ballast for the purpose of operating the discharge lamp.

DISCLOSURE OF THE INVENTION

The invention is based on a technical problem of specifying a dielectric barrier discharge lamp having at least two outer electrodes, it being possible for contact to be made in an advantageous manner with said dielectric barrier discharge lamp.

In addition, the invention is intended to specify a corresponding illumination system having such a lamp and an appropriate ballast and a method for making contact with the discharge lamp.

The technical problem is solved by a dielectric barrier discharge lamp, in which the electrodes are in the form of rods and are in the form of a plug connection element at one end.

In addition, the invention is also based on an illumination system having such a discharge lamp and having an electronic ballast for the purpose of operating the lamp, a plug connection element being fixedly connected to a housing of the ballast, said plug connection element being designed such that the lamp can be connected to the ballast with the end having the contacts as the complementary plug connection element by being plugged together with the plug connection element of the housing.

Finally, the invention is also based on a method for making contact with the discharge lamp, in which in each case one end of the rod-shaped electrodes, as the plug connection element, is plugged together with a complementary opposing plug connection element, and the discharge lamp is thus electrically connected.

The basic idea of the invention consists in the outer electrodes being in the form of rods and in the process being used as plug connection elements at one end. In this case, rod-shaped means that the electrodes have a certain intrinsic dimensional stability, and can thus be used as the plug connection element, i.e. are not foil electrodes. In particular, in this case the length and width of the electrodes transverse to the longitudinal extent should be comparable in terms of order of magnitude, for example should not differ from one another by more than a factor of 5.

In this case, the electrodes should be designed such that they can be connected to a complementary plug connection element in a form which can preferably be detached mechanically, i.e. can be isolated again without any fundamental damage. In this case, a plug connection is understood to mean a force-fitting connection, which takes place whilst maintaining the essential shape of the plug connection elements, of largely dimensionally stable elements. The plug connection is thus intended to be delimited by, for example, crimping connections, in the case of which contact is made with foil-like electrodes with a substantial change to the shape of said electrodes and without using dimensional stability.

The use of the electrodes themselves as plug connection elements provides a simple design and markedly simplifies the contact-making method.

In particular, the electrodes may be simple round rods and, in this case, either have a tube end as the so-called female element of the plug connection or end as a round rod as the so-called male element. The tube end, which is designed to accommodate a round rod, can therefore be present as the female plug connection element both on the electrode side and on the cable or ballast side. Corresponding designs are naturally also possible with cross sections other than the round cross section, but the round cross section is preferred.

A further refinement provides for the contact face between the electrodes, for example the mentioned round rods, and the discharge vessel to be increased in size by bridging taking place using a conductive, free-flowing substance and the bearing face thus being enlarged. This substance may be, for example, a conductive adhesive compound.

One particular refinement also provides for the electrodes not to be produced from a metal, as is conventional, but from a conductive plastic which can be deformed to a certain extent. The elasticity of this plastic can in the process firstly enlarge the bearing face on the discharge vessel and secondly simplify production of the plug connection.

However, metallic electrodes are likewise preferred.

One further refinement of the invention provides for the electrodes to be fitted to the discharge vessel by means of an interlocking connection with a sleeve surrounding the electrodes, said sleeve partially surrounding the circumference of the discharge vessel perpendicular to the longitudinal extent but in the process leaving an aperture free for light radiation purposes.

Also of concern is a corresponding production method in which the electrodes are fitted to a discharge vessel which is elongate in the form of a tube by means of an interlocking connection with a sleeve surrounding the electrodes such that the electrodes lie along the longitudinal extent of the discharge vessel, the sleeve leaving an aperture free for light radiation purposes.

The basic idea in this case consists in using a sleeve for the purpose of mounting the two or more outer electrodes. The sleeve is in this case a device which has sufficient intrinsic dimensional stability for holding the electrodes by means of an interlocking connection. The sleeve can therefore be used, so to speak, as a clip or clamping device. This makes it possible for an aperture to be left free in order for the discharge lamp to radiate light, with the result that the sleeve does not need to be transparent or particularly thin. The sleeve also does not need to be adhesively bonded. Furthermore, it allows for stabilization and/or protection of the discharge vessel against external effects and can therefore also contribute to a reduction in the wall thicknesses of the discharge vessel which is desired for weight reasons and for preventing voltages which are too high. In particular, the electrodes can be mounted on the discharge vessel by simply being clipped onto or inserted into the sleeve such that production of the discharge lamp is markedly simplified and accelerated at this point.

Preferred features of the invention are the fact that only the mentioned interlocking connection holds the electrodes, i.e. said electrodes are not also adhesively bonded to the discharge vessel or fixed in another way, and also the fact that the sleeve is prestressed for this purpose, i.e. still maintains a certain contact pressure even in the mounted state.

In addition, it is also preferred for the sleeve itself to be held on the discharge vessel only by means of an interlocking connection or else a force-fitting connection as a result of its intrinsic stability, i.e. to bear against said discharge vessel freely. It should therefore likewise not additionally be adhesively bonded.

Primarily as regards the stabilization and protective function of the sleeve already mentioned, it is preferred, but not absolutely necessary in the context of the invention, for the sleeve to extend essentially along the entire discharge vessel. In an individual case, one or more sleeves may also be used which make up only part of the longitudinal extent of the discharge vessel.

In addition, the above explanation relating to the interlocking connection and the intrinsic dimensional stability of the sleeve should not be understood in such a way that it needs necessarily be integral. Within the context of a particular refinement of the invention, in contrast provision is made for an at least two-part sleeve to be used. In this case, there may also be a functional differentiation, for example in the form of an outer shielding plate and an electrical insulation lying therein between the electrodes and the shielding plate. In such cases, the insulation itself need not necessarily be dimensionally stable although it should be understood to be part of the sleeve.

A further possibility for a two-part sleeve comprises two parts which have been split along the longitudinal extent of the discharge vessel and are adjacent and fixedly connected to one another in the mounted state, said parts producing an interlocking or force-fitting connection with respect to the discharge vessel in the connected state. Such parts can therefore also be placed on the discharge vessel without an interlocking and force-fitting connection and then connected to one another for the purpose of producing the interlocking or force-fitting connection. Possible connections are, in particular, clip connections between the two parts, preferably also undetachable clip connections. This embodiment is particularly suitable for sleeves which are not made from an essentially elastic material.

A further refinement of the invention provides for a modular arrangement, in a row, of individual discharge vessels which can be operated jointly almost as an integral discharge lamp. In the case of the already mentioned plug connections at the end of rod-shaped electrodes, the electrodes of the individual modules can be plugged together, and in the process the sleeves of individual modules could likewise be connected to one another or designed merely to adjoin one another, but it is also possible for a continuous sleeve to be used for a plurality of modules. Even without the mentioned plug connection, this design may be advantageous, for example, if the discharge vessels are arranged next to one another in a row in modular fashion in the manner described and are held by modular or continuous sleeves and in the process continuous, outer electrodes are held by the sleeve(s) in the manner according to the invention.

The frequencies used during operation of the discharge lamp are generally of the order of magnitude of a few 10 kHz, with the result that such discharge lamps produce interference radiation in EMC-sensitive conditions. This problem can advantageously be solved by a conductive metallic shield which partially surrounds the discharge vessel and in the process leaves an angle of opening free for light radiation purposes, at least one shielding face, limiting the angle of opening, of the shield being remote from the discharge vessel at its outermost end by a distance which is at least as great as half the average diameter of the discharge vessel transverse to the longitudinal extent.

Tubular discharge lamps of this type have a so-called aperture along their longitudinal extent, i.e. a longitudinally extending strip, from which light emerges from the lamp. In order to ensure good efficiency, this aperture should if possible not be covered directly by a shield, for which purpose known shields also leave the aperture completely free. However, the lamp then radiates over the entire region which is left free at the corresponding spatial angles. The shielding face provided by the invention delimits the spatial angle of this radiation and thus also defines an angle of opening of the light radiation. This angle of opening can be optimized in terms of the technically desired application, i.e. in an individual case the angle of opening may also be markedly smaller than is actually possible in the case of the aperture provided. In this case, however, the shielding face would not impair the luminous efficiency at the spatial angle relevant to the application, but would markedly improve shielding.

The basic idea of the invention thus consists in the shield not being limited to a conductive envelope, known per se, of the discharge vessel outside the angle of opening but the shield having at least one shielding face which extends away from the discharge vessel and in the process limits the angle of opening. The shield should therefore to a certain extent have a "mask" along at least one lateral boundary of the angle of opening. Corresponding shielding faces are preferably provided at both boundaries of the angle of opening, but a shielding face could also be dispensed with, for example, if the shield in the other direction is not important or is already provided for other reasons, for example by a metallic wall which is provided there in any case. The shielding face in this case does not necessarily need to run along its entire extent along the boundary of the angle of opening, i.e. does not necessarily need to extend essentially radially. At least its outermost end preferably limits the angle of opening. This outermost end is moreover remote from the discharge vessel in accordance with the invention at least by half the average diameter of the discharge vessel.

Moreover, it is also not absolutely necessary for the shield to surround the entire rest of the circumference of the discharge vessel apart from the angle of opening. Here too, owing to the lack of significance of the electromagnetic interference radiation in a specific direction or shielding elements which are provided there in any case, the reasons for a shield may be absent and/or there may be other physical reasons which allow a gap in the shield to appear advantageous.

However, it is preferable in the context of this invention for the shield to surround and shield the discharge vessel and therefore to preferably form the already described sleeve over more than half of the circumference of said discharge vessel. As is described in more detail below, this sleeve may also have advantageous properties as a mounting aid or holder.

The mentioned sleeve preferably has, over part of the circumference of the discharge vessel, particularly preferably over the remaining part, apart from the shielding face(s), a relatively small distance from the discharge vessel, to be precise in comparison with half the average diameter of the discharge vessel. The remaining part of the shield then forms the mentioned shielding face. For illustrative purposes, reference is made to the exemplary embodiments.

Although the shielding face according to the invention of the shield can limit the light radiation of the lamp and thus define an effective angle of opening at least towards one side, in many cases it is desirable to utilize as much as possible of the radiated light. If the extent of the aperture is based on the central point of the discharge vessel in cross section with respect to the longitudinal direction and this is considered to be the angle of opening, the angle of opening of the light radiation, based on the same central point, of the shield will preferably be greater than that of the aperture. In this case, the shielding face can moreover mask light radiated from the aperture, since the light radiation in the lamp also takes place from parts of the inner sheath which are closer to the aperture, with the result that the effective light radiation angle of the aperture is greater than the angle of opening when viewed radially.

In addition, the shield can also contain further shielding elements in the region of the angle of opening in addition to the shielding face(s), in particular flat shielding parts which extend essentially radially in cross section and further divide the angle of opening. The shield can thus also be slightly improved in the direction of the light radiation. Examples will be explained further below.

It may be important for the sleeve, if it is electrically conductive or contains electrically conductive parts, to be coupled to the electrode(s) in a manner which is not too capacitive. When the conductive part of the sleeve is mentioned below, i.e. for example the mentioned shielding plate, it is in this case preferred for an assumed radial thickness $d_D$ between the metallic sleeve and the outer electrode, i.e. approximately the thickness of the mentioned insulation layer within the metal shield, and a dielectric constant $\in_D$ of this layer and a thickness $d_B$ of the dielectric barrier between the electrode and the discharge medium at a corresponding dielectric constant $\in_B$ to overall fulfill the following relationship:

$$d_D/\in_D \geqq F \times d_B/\in_B,$$

where the factor F is at least 1.5, preferably at least 2 and particularly preferably at least 2.5. Reference is made to U.S. Pat. No. 6,304,028 B1 for further details in which it is also explained, inter alia, that the corresponding sum of the individual quotients of thickness and dielectric constant must be used in this relationship in the case of multilayer composites.

One simple and preferred possibility consists in at least one, preferably two end-side bases being provided on the lamp which are dimensioned to be radially slightly larger than the discharge vessel itself. If, in this case, the shield is fitted so as to bear against the base and is preferably mounted and held also in this form, the radial difference between the base and the discharge vessel gives the desired distance.

A further preferred refinement of the base relates to flattened sections on its cross-sectional shape (perpendicular to the longitudinal extent of the discharge vessel) which are provided so as to also match the shield, for example a correspondingly shaped metal sheet. In this case, when mounting the shield on the bases, the alignment of the flattened sections provides a correct orientation, i.e. in particular an alignment of an aperture of the lamp with the angle of opening defined by the shield. In this case, the base can naturally also contain further latching devices which match the shield. However, a latching or clamping action may also be provided by the sleeve shape alone, i.e. by the interlocking connection of the shield itself.

Moreover, the invention also relates to those discharge lamps in which the at least two opposing plug connection elements for the described electrode ends are included which are therefore, for example, already provided with a cable or packaged together with it. Preferred in this case is not only a plug connection which can be detached without any damage being caused but also a plug connection which can be produced by means of a purely translatory movement. Such plug connections are simple in design terms and allow for a particularly simple contact-making method.

Favorable geometric designs for the plug connection elements on the electrodes or the complementary plug connection elements are configured such that one element at least partially surrounds the complementary element. For example, with the connection described between a rod end and a tube end, the rod end is completely surrounded by the tube end. If, however, a widened flat end of a rod is inserted into a slot in a complementary element, the flat end is now only surrounded on two sides, i.e. only partially, by the complementary element. This means that one element bears on at least two sides of the other element "laterally" in relation to the longitudinal direction.

The electrode ends to be used as plug connection elements preferably protrude beyond the discharge lamp and can thus be reached particularly easily for the purpose of connecting them to the complementary plug connection elements. This design has proven successful in particular in connection with the embodiments explained below.

In a further embodiment, the invention relates to an illumination system having the discharge lamp, in which a plug connection element is fixedly connected to a housing of the ballast, said plug connection element being designed such that the lamp can be connected to the ballast with the end having the electrode ends as contacts as a complementary plug connection element by being plugged together with the plug connection element of the housing.

Above all, this has advantages for the method for connecting the discharge lamp to the electronic ballast, in which the discharge lamp, as the plug connection element, is therefore inserted into a plug connection element, which is designed to be complementary thereto, on the ballast.

The basic idea of this aspect consists in the discharge lamp being designed to have a discharge vessel, which is elongate in the form of a tube, to a certain extent as the plug connection element itself. For this purpose, the discharge lamp has, at one end, the explained electrode ends for the electrical connection and is connected with this end to a correspondingly designed, complementary plug connection element which is fixedly connected to the ballast, i.e. to the housing of said ballast. In this case, it is naturally possible for the ballast-side plug connection element to be connected to a printed circuit board of the ballast via a cable, but a direct mechanical connection between the lamp and the ballast should be created by the plug connection.

It is preferable in this case for the ballast-side plug connection element to not only be fixedly connected to the housing but to be integrated in the housing. In other words, the plug connection element should not be fixed. A flexible cable between the ballast housing and the lamp in the form of a flexible mechanical connection therebetween is therefore dispensed with. It is preferable for the plug connection element to be integrated flat in the ballast housing, i.e. to be in the form of a recess in an otherwise, for example, parallelepipedal housing, into which recess the tubular lamp itself can be inserted with one end. For illustrative purposes, reference is made to the exemplary embodiment.

The ballast-side plug connection element is preferably a plug socket, i.e. a female element in relation to the tube shape of the lamp.

Preferred applications of the discharge lamp according to the invention and of the illumination system according to the invention are not only in office automation but also in UV radiators. Such UV radiators can be used for various technical processes. Of particular interest in the context of this invention is the illumination of catalyst surfaces for photocatalysis of reactions. A preferred example of an application is one in air purification, in particular in vehicles, for example motor vehicles. In this case, air pollutants can be converted by a photocatalytic process and thus eliminated, and the vehicle interior can thus be supplied with air having a much better quality than that in the outside world.

BRIEF DESCRIPTION OF THE DRAWINGS

The invention will be explained in more detail below with reference to the exemplary embodiments, it being possible for the individual features also to be essential to the invention in other combinations.

BEST MODE FOR CARRYING OUT THE INVENTION

Firstly, reference is made to U.S. Pat. No. 6,304,028 B1 which has already been mentioned above for the purpose of illustrating the design of a typical dielectric barrier discharge lamp having a tubular discharge vessel. Explanations which have already been given in this document are not repeated below. Instead, the description of the exemplary embodiments concentrates on the differences from this prior art.

Figure 1:
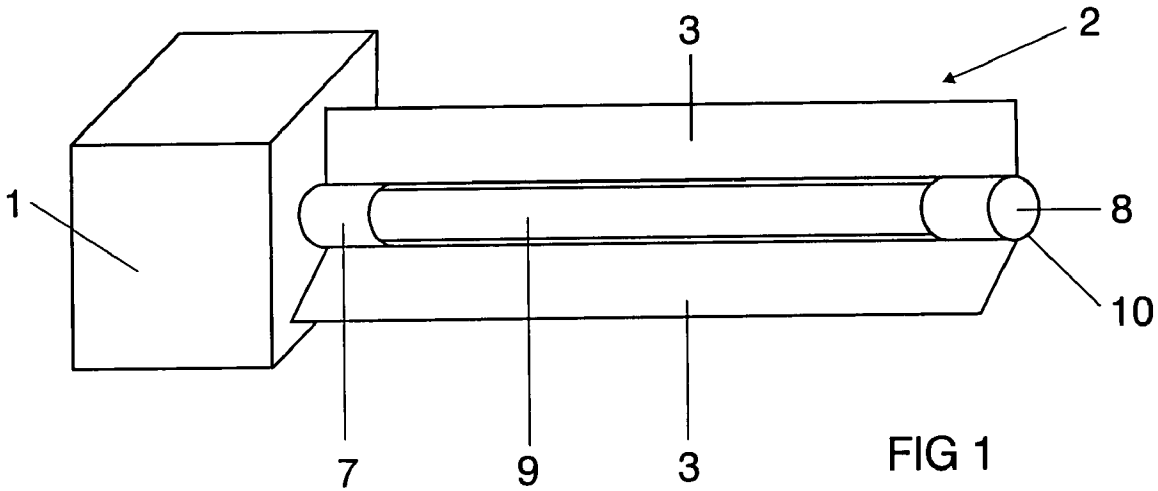
FIG. 1 shows a schematic, perspective view of an illumination system according to the invention.

FIG. 1 of the present application shows an illumination system according to the invention having an electronic ballast 1 which is illustrated here as a simple parallelepiped. The figure shows only the housing of the ballast 1 which contains the circuit components, which are moreover known per se, of a ballast for operating a dielectric barrier discharge lamp. Of concern here is, in particular, a class E converter.

Figure 2:
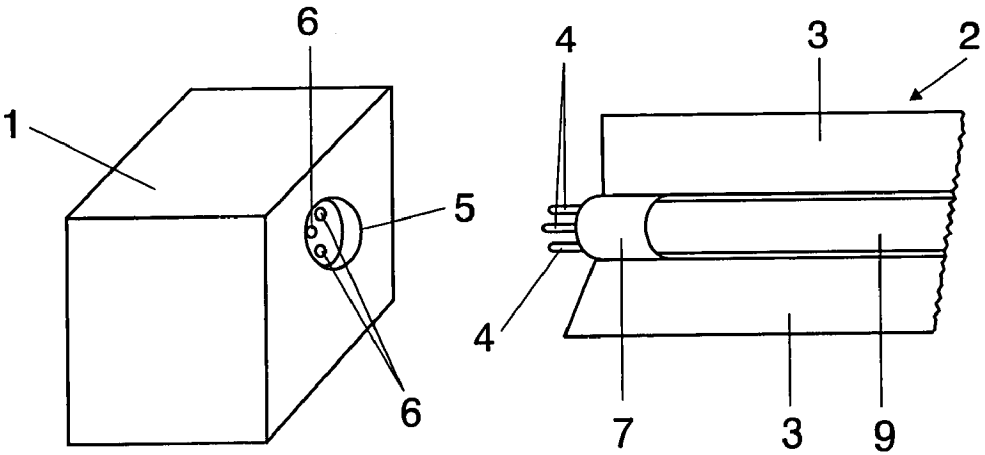
FIG. 2 shows the illumination system from FIG. 1 in the case of a discharge lamp which has been removed from the ballast.
Figure 3:
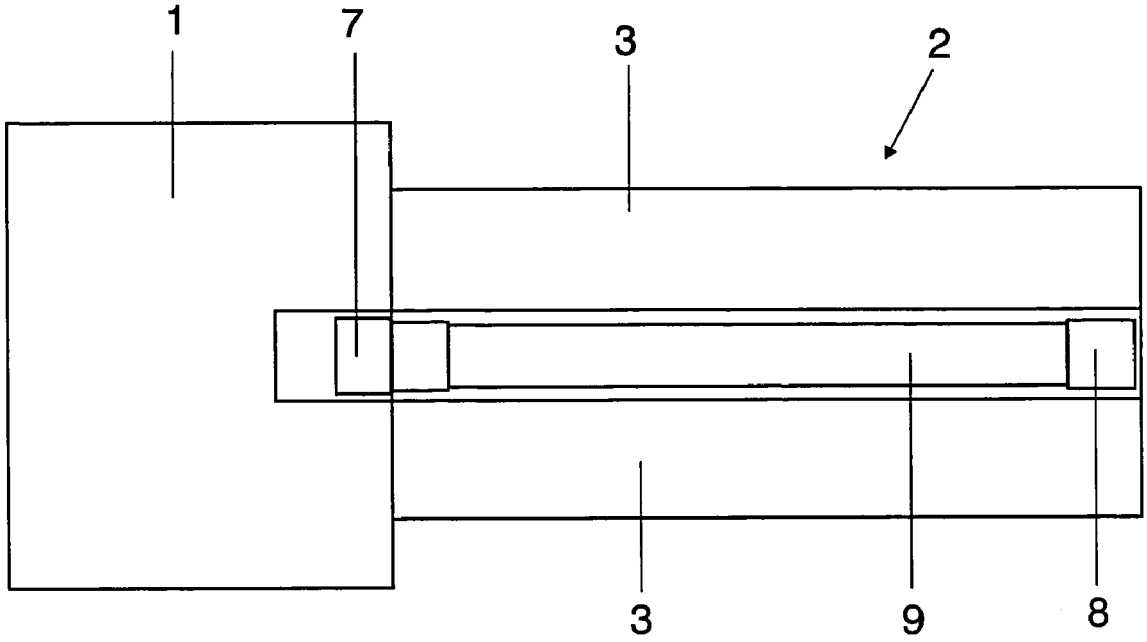
FIG. 3 shows a schematic plan view of the illumination system shown in FIG. 1.

The figure shows the fact that an essentially linear dielectric barrier discharge lamp 2 having two laterally protruding shielding faces 3 is inserted into the rear region of that side of the ballast 1 which is on the right in FIG. 1. FIG. 2 shows, using a detail of the ballast 1 and the lamp 2 shown in FIG. 1, a situation in which the lamp 2 has been withdrawn from the ballast 1. FIG. 3 shows a plan view of the situation in FIG. 1.

It can be seen in FIG. 2 that a base 7 of the tubular lamp 2 protrudes to the left beyond the shielding faces 3, and this cylindrical, protruding base 7 has three further-reaching, axially extending electrode ends 4. In addition, FIG. 2 indicates that the ballast 1 has, in its right-hand side face of the otherwise parallelepipedal housing shape, a plug socket receptacle 5 suitable for this purpose having female plug connection elements 6 provided therein for the mentioned axial electrode ends 4 of the discharge lamp 2.

The axial electrode ends 4 are the ends, on the left-hand side in FIGS. 1-3, of round rod-shaped electrodes of the lamp 2 which will be explained in more detail with reference to FIGS. 4-9. As shown in FIG. 2, these electrode ends are inserted into the described plug socket 5 with the plug connection elements 6 together with the base 7, which protrudes beyond the shielding faces 3, of the discharge lamp 2. As shown in FIGS. 1 and 3, the lamp 2 is as a result not only electrically connected to the ballast 1 but is also mounted fixedly on it. The ballast 1 therefore acts as a lampholder. A flexible cable between the lamp 2 and the ballast 1 can therefore be dispensed with.

That part of the lamp 2 which reaches beyond the shielding faces 3 is a plastic base 7 which holds, together with a second base 8 which can be seen in FIGS. 1 and 3, a tubular glass discharge vessel 9 in a shielding plate 10 which has the shielding faces 3 and is described in more detail below. In FIGS. 2 and 3, the shielding plate 10 with the shielding faces 3 is electrically conductively connected to the metallic housing of the ballast 1. This can take place, for example, by a small pin (not illustrated in FIGS. 1 and 2) which bears against the outer circumference of the base 7 and is inserted with this base 7 into the plug socket 5. The shielding plate 10 is insulated from the electrodes with the ends 4 via an insulating layer which is not illustrated here but is illustrated in FIG. 4. This insulating layer is a plastic layer. This plastic insulation is not provided in that part of the discharge vessel 9 which is visible in FIGS. 1-3 between the shielding faces 3, namely the aperture for light radiation purposes. The shielding plate 10 forms a sleeve with the bases 7 and 8.

Figure 4A:
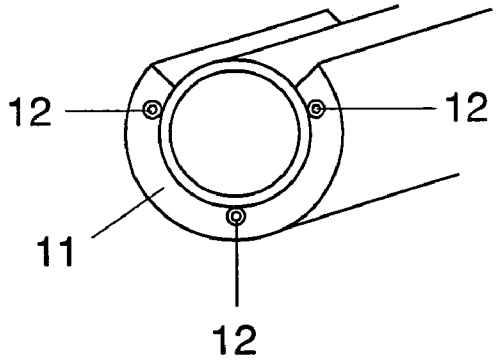
FIG. 4*a* shows a schematic, perspective view of one end of the discharge lamp shown in FIGS. 1-3 in accordance with an alternative embodiment.

In FIG. 4*a*, the shielding plate 10 with the shielding faces 3 are omitted in order to provide a simple illustration. FIG. 4*a* shows one variant of the mentioned plastic insulation in the form of a base 11 running along the length of the lamp and otherwise electrode ends 12 which firstly do not reach beyond the base 11 and which secondly have a tubular shape. Of concern here are female plug connection elements at the electrode ends in contrast to the male plug connection elements in FIG. 2. Correspondingly, a complementary ballast (not illustrated) has male plug connection elements in a plug socket comparable to the plug socket 5 in FIG. 2. The electrodes are inserted into appropriate recesses in the base 11 and are held on the discharge vessel by said base 11 in an interlocking manner. The base 11 runs along the length of the lamp and merges with the base (8 in FIGS. 1 and 3) at the opposite lamp end. It is held under prestress with respect to the discharge vessel 9 by the shielding plate 10 and is held on said discharge vessel without further measures. The discharge vessel 9 is therefore a simple gas-filled tube having inner fluorescent and reflective layers.

Since in this case the insulating layer between the electrodes and the shielding plate 10 is at the same time in the form of a base corresponding to the base 7 in FIG. 2, the base therefore does not surround the entire circumference of the discharge vessel end.

In both cases, the embodiment in FIGS. 1-3 and that in FIG. 4*a*, the shielding plate 10 bears in a force-fitting and interlocking manner about the base and the insulation, and an assembly connection is therefore ensured.

Figure 4B:
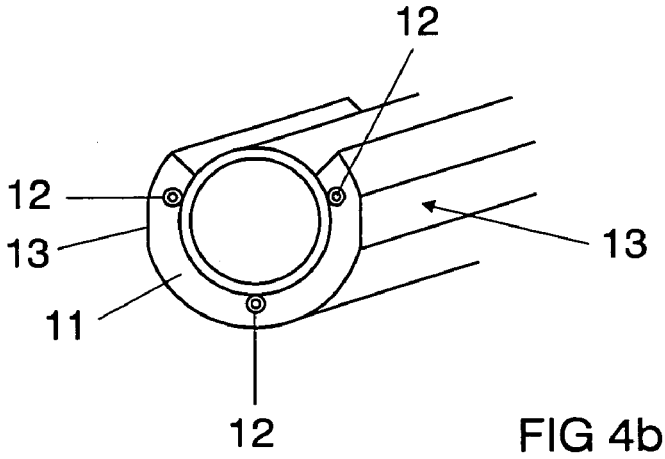
FIG. 4*b* shows a variant of FIG. 4*a*.

FIG. 4*b* shows one variant of FIG. 4*a* in which additional flattened sections 13 are provided there in the lateral regions of the base 11. These flattened sections 13 are provided in complementary fashion on a shielding plate 10, which is in this case not illustrated in the drawings, corresponding to FIGS. 1-3, with the result that the aperture can be aligned correctly with the shielding faces 3.

The base 7 shown in FIG. 2 may also be designed such that it correspondingly adjusts the distance from the shielding plate 10 exclusively at the ends of the discharge vessel 9, and such that the insulation is introduced into the axial intermediate region only loosely.

The plug connection illustrated in FIGS. 1-3 between the discharge lamp 2 and the ballast 1 is, of course, not obligatory in the invention. Electrode ends in the form of plug connection elements can also be expedient without this feature, for example if a corresponding female plug connection head of a connection cable, which matches the electrode ends and optionally also, similarly to the socket 5, matches the base 7 or the discharge vessel 9, is provided instead of the plug socket 5 of the ballast 1.

Figure 5:
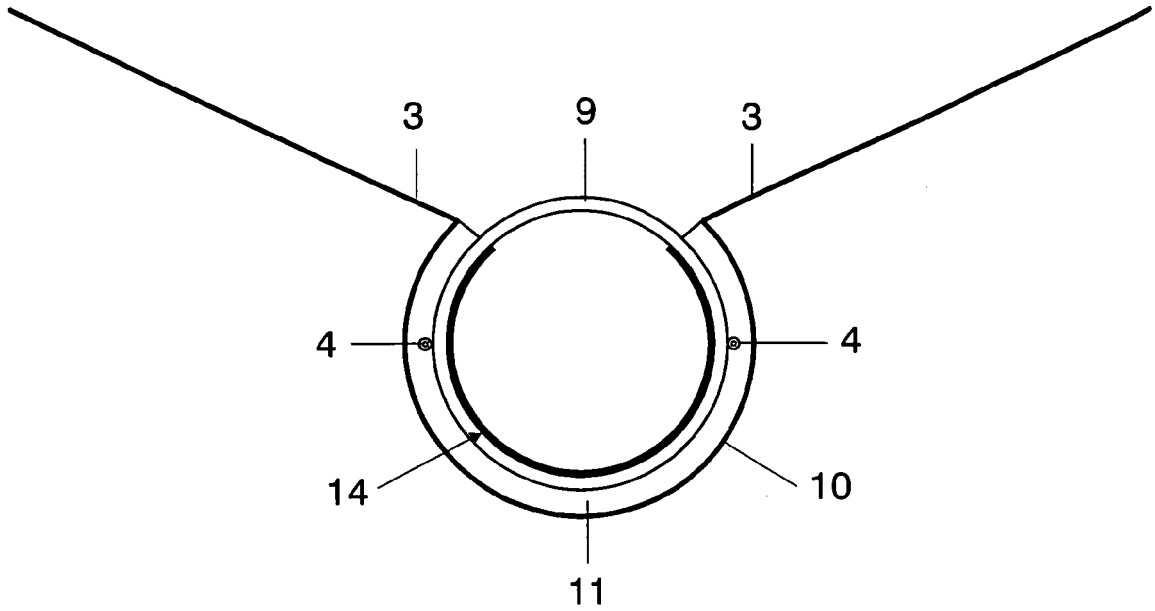
FIGS. 5-9 each show schematic front views of discharge lamps in accordance with alternative embodiments.
Figure 6:
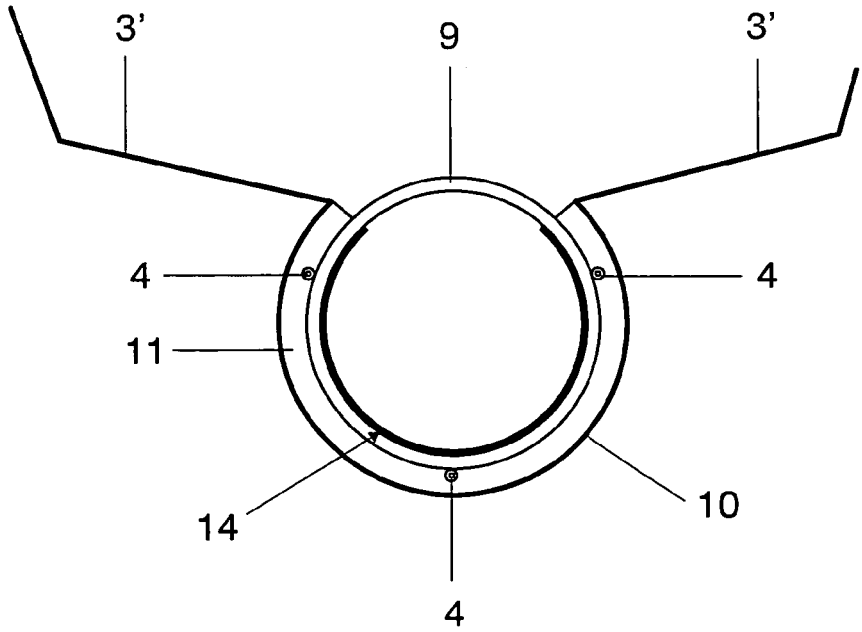

FIGS. 5-9 show a few variants of the discharge lamps shown in FIGS. 1-4*b*. In this case, only two electrodes 4 are provided in FIG. 5 instead of three electrodes (or electrode ends) 4 as in FIG. 2. Both variants are possible. Three electrodes are occasionally selected in order to achieve better luminous efficiency. These differences are not of particular significance for the present invention. In addition, the angle of opening between the shielding faces 3, i.e. the blade-like ends of the sleeve 10, is in this case selected to be slightly smaller. This angle of opening, however, is dimensioned such that it does not noticeably impede the actual emergence of light from the aperture in the upper region of the section illustrated in FIG. 5. However, these shielding faces 3 serve the purpose of improving the electromagnetic shielding in the lateral direction owing to stray fields emerging from the aperture. FIG. 5 illustrates the aperture by a fluorescent layer 14 being illustrated there which is interrupted in the region of the aperture.

In contrast to FIG. 5, FIG. 6 again shows three electrodes 4, but the essential difference consists in the fact that the shielding faces 3' in FIG. 6 are in this case supplemented by inwardly bent parts and thus delimit an angle of opening which is slightly narrower still. Based on the circle center point of the discharge vessel, this angle of opening is still markedly larger than the angle of opening of the aperture. However, since the edge regions of the fluorescent layer 14 also radiate light, the outermost regions of the light radiation are already masked. The shielding effect, however, is correspondingly improved.

The bent shape of the shielding faces 3' can in this case take physical conditions in the environment into consideration, for example if the illumination system (in the sense of FIG. 1) is intended to be used in an environment with predetermined physical conditions, or if such a design appears to be advantageous for assembly purposes. FIG. 1 has already illustrated the fact that the shielding plate 10 not only serves the purpose of holding the electrodes on the discharge vessel 9 but also stabilizes the assembly of the entire discharge lamp 2 on the ballast 1. If necessary, the shielding faces 3 may also be mounted specially, for example clamped, plugged or screwed onto the ballast 1. Moreover, they may also have an assembly function with respect to components other than the ballast housing.

Figure 7:
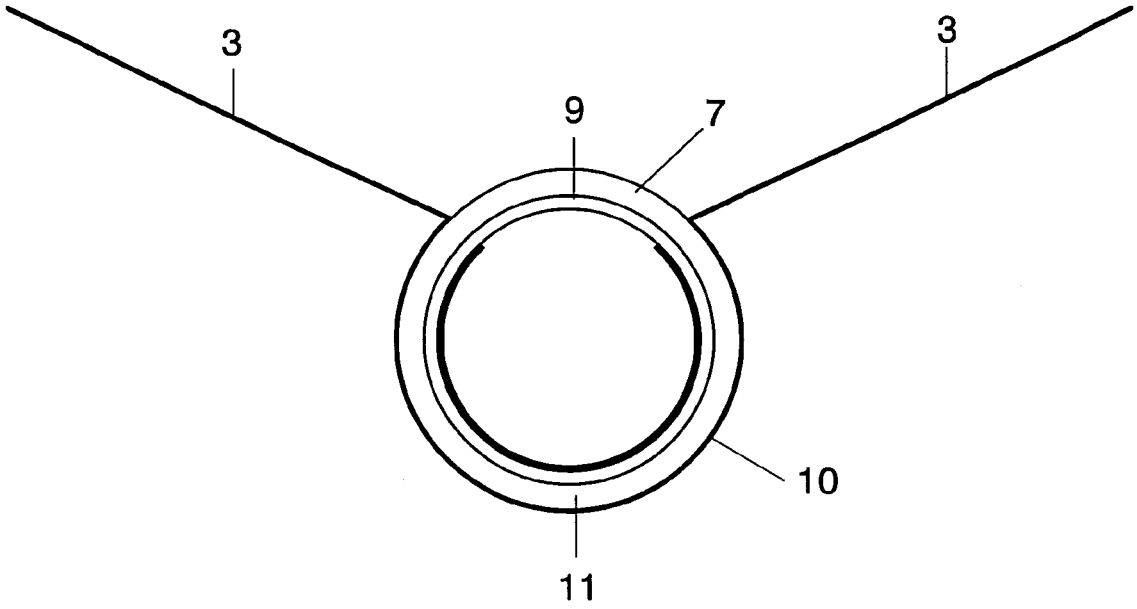

FIG. 7 shows a further variant of FIG. 5 having an angle of opening, which is again narrowed, of the shielding faces 3, but in this case with straight shielding faces 3. In this case, the base 7 as shown in FIG. 2 runs around the entire circumference of the discharge vessel 9 and does not leave the aperture free, as in FIG. 4. Since the base 7, however, is only fitted to the outermost edge, this does not disturb, or hardly disturbs, light radiation.

Figure 8:
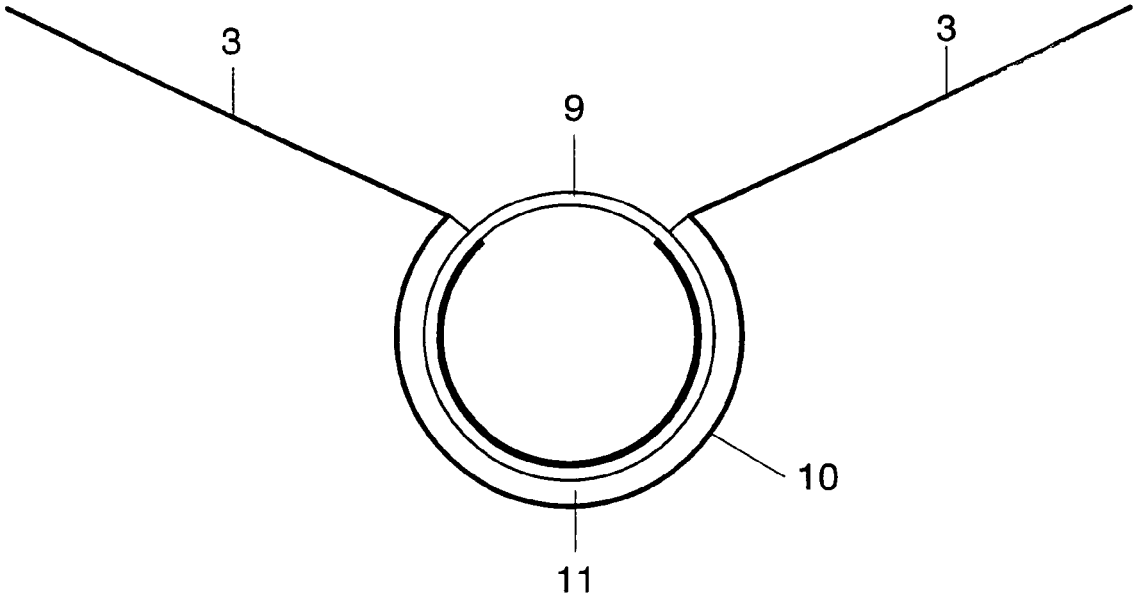

FIG. 8 differs from FIG. 7 precisely by this lastmentioned feature. Here too, the aperture is left free. The base is therefore a base 11 corresponding to FIG. 4.

Figure 9:
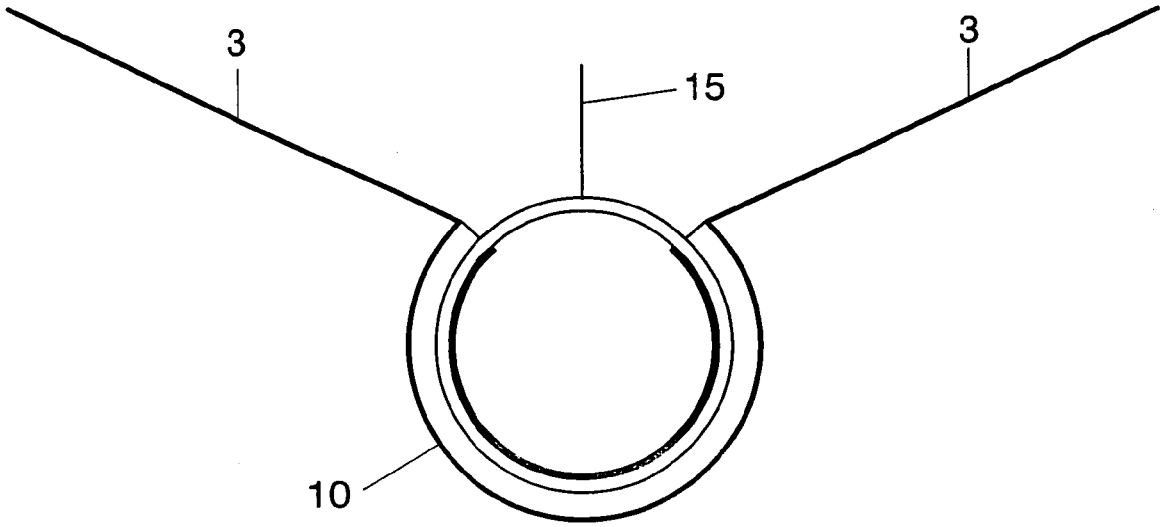

FIG. 9 differs from FIG. 8 by an additional shielding part 15 in the angle of opening both of the shielding faces 3 and the aperture. This is radial in the cross section illustrated and otherwise flat and can be seen better in the perspective view in FIG. 10. It reduces the light radiation through the aperture slightly, but improves the electromagnetic shielding in the light radiation direction as well. Such a part 15 may be a cost-effective alternative or else an additional measure to a transparent, conductive coating of the aperture, as is illustrated in the above-cited EP specification. For reasons of clarity, the details of the plug connection are omitted in FIG. 10.

Figure 10:
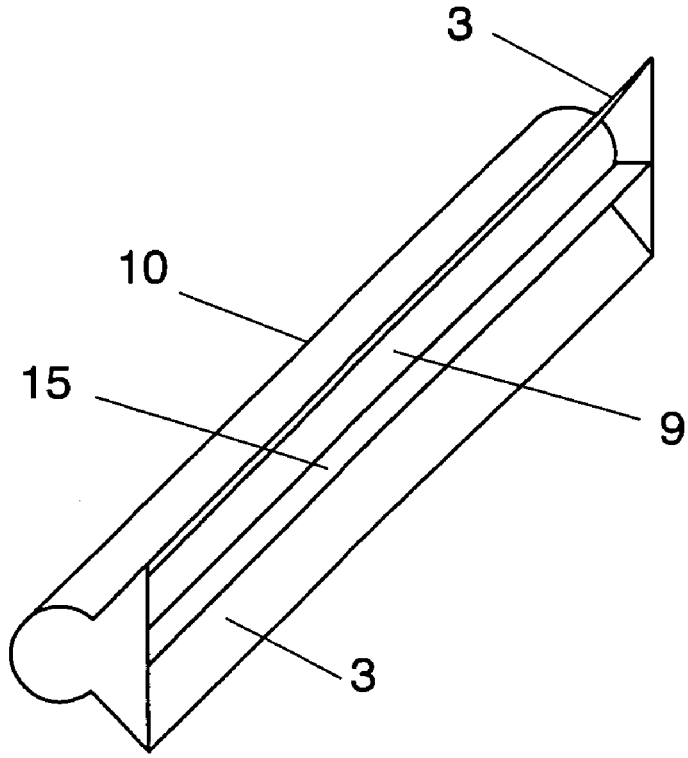
FIG. 10 shows a perspective illustration of one variant of a shielding plate of the discharge lamp shown in FIGS. 1-3.
Figure 11:
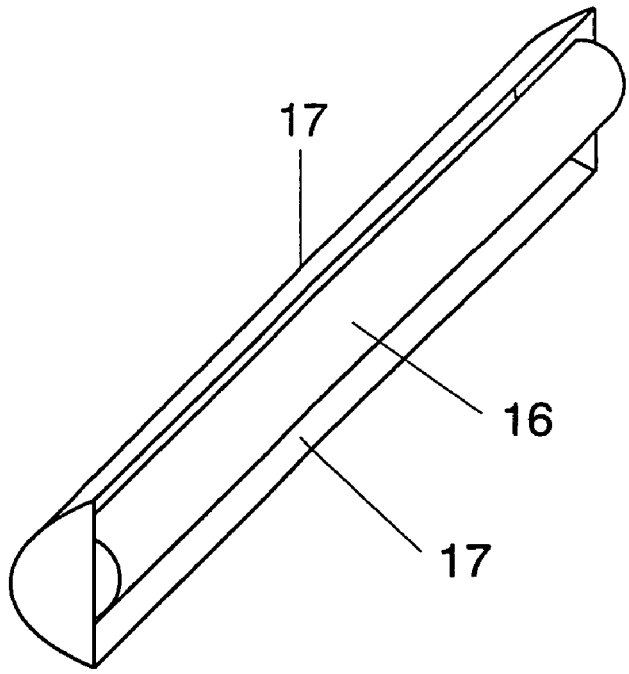
FIG. 11 shows a perspective illustration of a further variant of a shielding plate of the discharge lamp shown in FIGS. 1-3.

FIG. 11 shows an illustration similar to that in FIG. 10 of a variant of the design of the shielding plate 10. In this case, the shielding plate 10 with the shielding faces, when viewed in section, in principle comprises two concentric semicircles 16 and 17 having substantially different diameters about the circle center point of the section through the discharge vessel 9. The semicircles 16, 17 face one another with their openings. In contrast to the previous variants, in this case the smaller of the semicircles 16 also has a markedly greater distance from the discharge vessel 9, which is not illustrated here. As a result, even the smaller semicircle 16 acts as a reflector, reflects the light radiated by the aperture into it (i.e.

towards the right in FIG. 11) into the larger semicircle 17 which in turn reflects the light out of the sleeve. This variant provides markedly poorer luminous efficiency than the previous examples but shows considerably improved EMC shielding.

Figure 12:
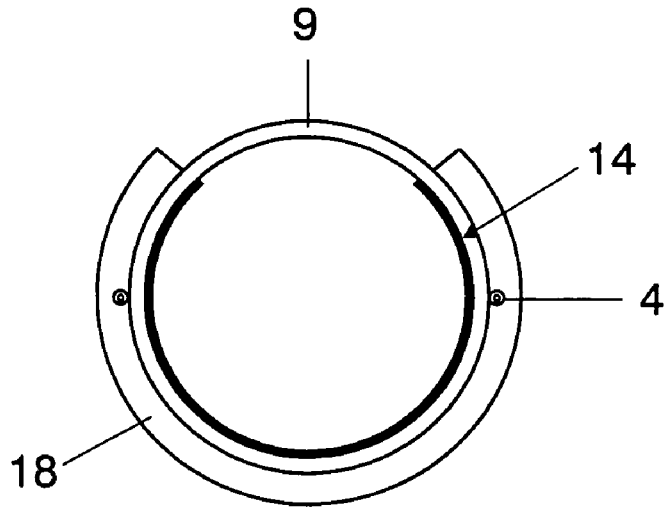
FIGS. 12-16 show alternative embodiments of the discharge lamp in front views which are comparable with FIGS. 5-9.

FIG. 12 corresponds to the illustration in FIGS. 5-9 but is an exemplary embodiment without a shielding plate. In this case, the sleeve is in the form of an interlocking and force-fitting plastic sleeve 18 which has corresponding shaped recesses for the electrodes 4 and thus holds them on the discharge vessel 9. The shielding effect explained above is dispensed with here or could be provided by a shielding plate without shielding faces; the other advantages of the sleeve are likewise provided, however.

Figure 13:
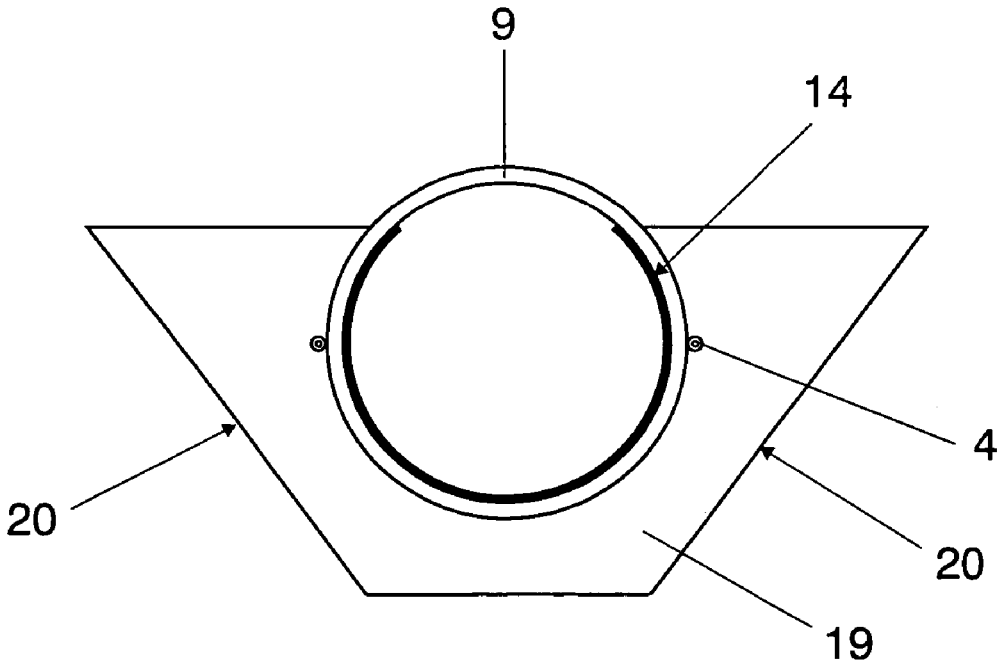

FIG. 13 shows another shape 19 of such a sleeve which is also designed to be markedly more solid. For example, it could be used for assembly in a corner position and has inclined faces suitable for this purpose which are at right angles with respect to one another and are denoted 20.

Figure 14:
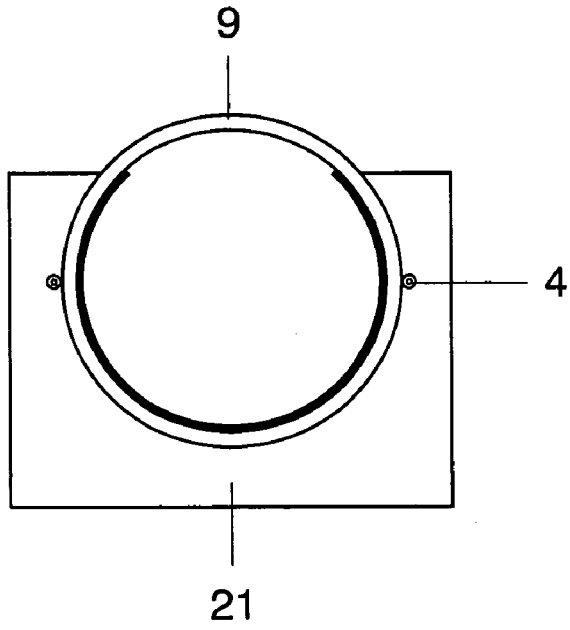
Figure 15:
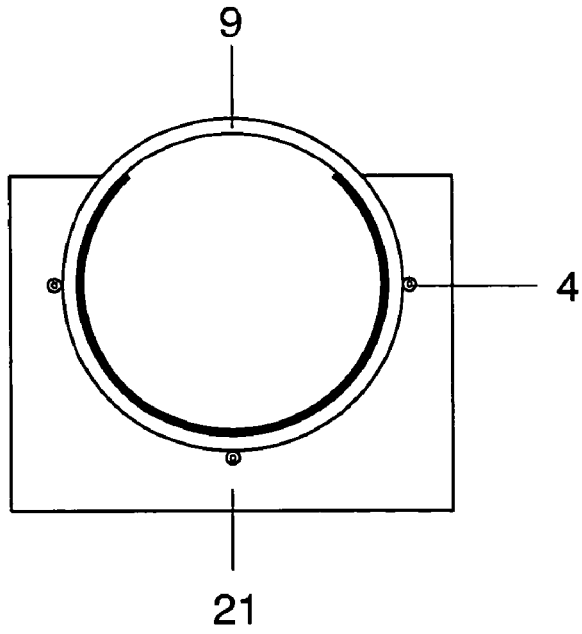

FIGS. 14 and 15 show similar variants to that in FIG. 13 but with an almost square cross section for the sleeve 21 and with two electrodes 4 in FIG. 14 and three electrodes 4 in FIG. 15.

Figure 16:
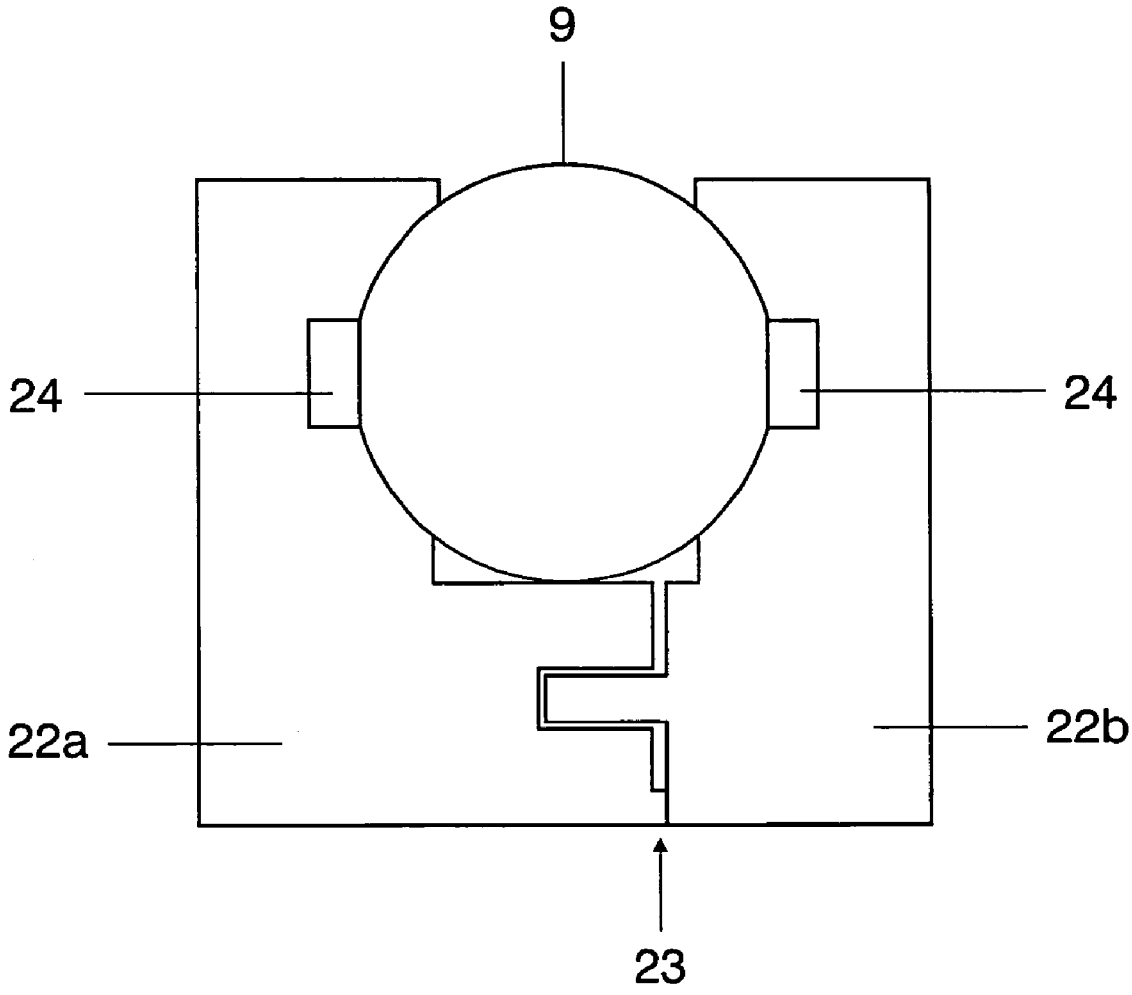

Finally, FIG. 16 shows a two-part variant of a sleeve. In contrast to the two-part design having a shielding plate and insulation, in this case a plastic sleeve 22 is formed from a left-hand part 22*a* and a right-hand part 22*b* which can be connected via clip connections beyond a separating slot denoted 23. The two parts 22*a* and 22*b* together provide a similar cross-sectional shape to that of the sleeve 21 in FIGS. 14 and 15, but neither of the two halves produces an interlocking or force-fitting connection per se. The two parts are therefore placed on the discharge vessel 9 from the left and right and then clipped to one another via a preferably undetachable clip connection in the slot 23 and are thus prestressed with respect to the discharge vessel 9. Of course other cross-sectional shapes can also be produced with comparable embodiments, in particular those such as in the remaining exemplary embodiments.

FIG. 16 also illustrates the fact that the electrodes, in this case denoted 24, may also have cross-sectional shapes other than round cross-sectional shapes.

What is claimed is:

1. A dielectric barrier discharge lamp comprising a discharge vessel and having at least two electrodes which are fitted to the outside of the discharge vessel, the electrodes being in the form of rods and being in the form of a plug connection element at one end.

2. The discharge lamp as claimed in claim 1, in which the electrodes are round rods.

3. The discharge lamp as claimed in claim 2, in which the electrodes are made from a deformable, electrically conductive plastic.

4. The discharge lamp as claimed in claim 2, having a discharge vessel which is elongate in the form of a tube and in which the electrodes are fitted to the outside of the discharge vessel along the longitudinal extent of the discharge vessel by means of an interlocking connection with a sleeve surrounding the electrodes, said sleeve partially surrounding the circumference of the discharge vessel perpendicular to the longitudinal extent but in the process leaving an aperture free for light radiation purposes.

5. The discharge lamp as claimed in claim 2 having a discharge vessel which is elongate in the form of a tube and having a conductive metallic shield which partially surrounds the discharge vessel and in the process leaves an angle of opening free for light radiation purposes, at least one shielding face of the shield being remote from the discharge vessel at its outermost end by a distance which is at least as great as half the average diameter of the discharge vessel transverse to the longitudinal extent.

6. The discharge lamp as claimed in claim 2 which has a plurality of discharge vessels, which are arranged next to one another in a row in the direction of longitudinal extent and can be operated jointly, the electrodes on the respective discharge vessels being connected to one another by their ends in the form of plug connection elements.

7. The discharge lamp as claimed in claim 2 having at least two opposing plug connection elements which are formed in complementary fashion to the electrode ends in the form of plug connection elements.

8. The discharge lamp as claimed in claim 1, in which the electrodes nestle up flat against the discharge vessel wall with a conductive, free-flowing substance.

9. The discharge lamp as claimed in claim 1 having a discharge vessel which is elongate in the form of a tube and in which the electrodes are filled to the outside of the discharge vessel along the longitudinal extent of the discharge vessel by means of an interlocking connection with a sleeve surrounding the electrodes, said sleeve partially surrounding the circumference of the discharge vessel perpendicular to the longitudinal extent but in the process leaving an aperture free for light radiation purposes.

10. The discharge lamp as claimed in claim 1 having a discharge vessel which is elongate in the form of a tube and having a conductive metallic shield which partially surrounds the discharge vessel and in the process leaves an angle of opening free for light radiation purposes, at least one shielding face of the shield being remote from the discharge vessel at its outermost end by a distance which is at least as great as half the average diameter of the discharge vessel transverse to the longitudinal extent.

11. The discharge lamp as claimed in claim 1 which has a plurality of discharge vessels, which are arranged next to one another in a row in the direction of longitudinal extent and can be operated jointly, the electrodes on the respective discharge vessels being connected to one another by their ends in the form of plug connection elements.

12. The discharge lamp as claimed in claim 1 having at least two opposing plug connection elements which are formed in complementary fashion to the electrode ends in the form of plug connection elements.

13. The discharge lamp as claimed in claim 12, in which the plug connection elements and opposing plug connection elements are designed such that the plug connection can be detached without any damage being caused.

14. The discharge lamp as claimed in claim 12, in which the plug connection elements and opposing plug connection elements are designed such that the plug connection can be produced by means of a purely translatory movement.

15. The discharge lamp as claimed in claim 13, in which the plug connection elements at least partially surround the opposing plug connection elements, or vice versa.

16. An illumination system having the dielectric barrier discharge lamp as claimed in claim 1, which has a discharge vessel which is elongate in the form of a tube and contacts, which are fitted at one end of the discharge vessel, for electrically connecting the lamp, and having an electronic ballast for the purpose of operating the lamp, a plug connection element being fixedly connected to a housing of the ballast, said plug connection element being designed such that the lamp can be connected to the ballast with the end having the contacts as the complementary plug connection element by being plugged together with the plug connection element of the housing.

17. A method for making contact with the discharge lamp as claimed in claim 1, in which in each case one end of the rod-shaped electrodes, as the plug connection element, is plugged together with a complementary opposing plug connection element, and the discharge lamp is thus electrically connected.

18. The method as claimed in claim 17, in which plugging-in takes place in purely translatory fashion.

19. The method as claimed in claim 17, in which the plug connection is detached again, once the discharge lamp has been electrically connected, by the plug connection elements and the opposing plug connection elements being pulled apart from one another, and the lamp is therefore isolated from its electrical connection.

20. The use of the discharge lamp as claimed in claim 1 as a UV radiator for the purpose of illuminating a catalyst.

21. The use as claimed in claim 20, in which the catalyst is used for air purification purposes in a vehicle.

22. The discharge lamp as claimed in claim 1, in which the electrodes, transverse to their longitudinal extent, have a length and width that differ from each other by no more than a factor of 5.

23. A dielectric barrier discharge lamp comprising a discharge vessel and having at least two electrodes which are fitted to the outside of the discharge vessel, the electrodes being in the form of rods and being in the form of a plug connection element at one end, in which the electrodes are made from a deformable, electrically conductive plastic.

24. A dielectric barrier discharge lamp comprising a discharge vessel and having at least two electrodes which are fitted to the outside of the discharge vessel, the electrodes being in the form of rods and being in the form of a plug connection element at one end, in which the electrodes are round rods, and in which the electrodes nestle up flat against the discharge vessel wall with a conductive, free-flowing substance.

* * * * *